US006453714B2

(12) United States Patent
Kido et al.

(10) Patent No.: US 6,453,714 B2
(45) Date of Patent: Sep. 24, 2002

(54) METHOD OF FORMING AN ECCENTRICALLY EXPANDED PIPE AND ECCENTRICALLY PIPE-EXPANDING DEVICE

(75) Inventors: Tsuguo Kido; Tetsuji Omori; Seiji Yamamoto; Yuji Nakada, all of Okazaki (JP)

(73) Assignee: Futaba Industrial Co., Ltd., Okazaki (JP)

( * ) Notice: Subject to any disclaimer, the term of this patent is extended or adjusted under 35 U.S.C. 154(b) by 0 days.

(21) Appl. No.: 09/819,514

(22) Filed: Mar. 27, 2001

(30) Foreign Application Priority Data

Mar. 29, 2000 (JP) ..... 2000-091493

(51) Int. Cl.[7] ..... B21D 41/02
(52) U.S. Cl. ..... 72/297; 72/370.04; 72/370.06
(58) Field of Search ..... 72/295, 296, 297, 72/370.04, 370.06, 370.08, 370.1

(56) References Cited

U.S. PATENT DOCUMENTS 2,506,657 A * 5/1950 Webster ..... 72/356
4,827,590 A * 5/1989 Metzger ..... 72/370.04
6,260,401 B1 * 7/2001 Tada ..... 72/370.06

FOREIGN PATENT DOCUMENTS

JP 11-239835 9/1999 ..... B21D/41/02
JP 2000-271676 10/2000 ..... B21D/41/02

* cited by examiner

*Primary Examiner*—Lowell A. Larson
(74) *Attorney, Agent, or Firm*—Davis & Bujold, P.L.L.C.

(57) ABSTRACT

In forming a fuel inlet pipe FP, (1) a portion of a base pipe is expanded by use of an expander punch to form a processed pipe comprising a neck portion, of which the diameter is the same as that of the base pipe, a tapering portion, and an expanded portion, all of these portions being connected in coaxial relation to one another (coaxially expanding process); and (2) a central axis of the neck portion and a central axis of the expanded portion are decentered relative to each other, and the expanded portion of the processed pipe is further expanded by use of an expander punch having a diameter larger than that of the expander punch used in the coaxially expanding process, thereby forming the fuel inlet pipe FP (eccentrically expanding process). The coaxially expanding process is performed one time or a plurality of times, while the eccentrically expanding process is performed only one time.

11 Claims, 6 Drawing Sheets

METHOD OF FORMING AN ECCENTRICALLY EXPANDED PIPE AND ECCENTRICALLY PIPE-EXPANDING DEVICE

FIELD OF THE INVENTION

The present invention relates to a method of forming an eccentrically expanded pipe and an eccentrically pipe-expanding device suitable for use in the method.

BACKGROUND OF THE INVENTION

As shown in FIG. 6, a fuel inlet pipe FP comprises a large-diameter portion FPa, a gradually changing portion FPb, and a small-diameter portion FPc, in which a central axis of the large-diameter portion FPa and that of the small-diameter portion FPc are in eccentric relation to each other. In the fuel inlet pipe FP, the diameter of the large-diameter portion FPa is 1.9 or more times greater than that of the small-diameter portion FPc. Moreover, as mentioned above, the central axis of the small-diameter portion FPc is in eccentric relation to that of the large-diameter portion FPa. For these reasons, it has been difficult to produce the fuel inlet pipe FP by a pipe-expanding method, and it has been usual to produce it by welding three parts, i.e., the large-diameter portion FPa, gradually changing portion FPb, and small-diameter portion FPc.

Now, in order to integrally form such a fuel inlet pipe FP by use of the pipe-expanding method, the following procedure is undertaken.

In general, if a pipe is expanded to such an extent that a limit of expandability of its material is exceeded, an expanded portion of the pipe is cracked or a base pipe portion (non-expanded portion) of the pipe is buckled and, therefore, it is impossible to highly expand the pipe in one process. Accordingly, a fuel inlet pipe to be expanded at a high expansion ratio, such as the fuel inlet pipe FP as shown in FIG. 6, is gradually expanded through a plurality of pipe-expanding operations. Also, in order to place the large-diameter portion FPa and the small-diameter portion FPc in eccentric relation, the small-diameter portion FPc is decentered little by little relative to the large-diameter portion FPa, while the pipe is expanded in stages.

However, in cases where a pipe is eccentrically expanded, the pipe is partially expanded in a large degree because of decentering, and an expansion ratio becomes substantially high in such a portion where the pipe is highly expanded. As a result, even if the pipe is eccentrically expanded little by little in stages, there is still a strong possibility that the pipe is cracked in the portion where it is highly expanded.

SUMMARY OF THE INVENTION

The present invention was made to solve the aforementioned problem. More specifically, an object of the invention is to provide a method of eccentrically expanding a pipe in which formation of cracks or the like is prevented even if a desired expansion ratio is high, and in which an eccentrically expansion pipe can be integrally formed. Also, another object of the invention is to provide an eccentrically pipe-expanding device which is suitable for use in the method.

In order to attain the aforementioned objects, there is provided a method for forming an eccentrically expanded pipe, the method comprising a coaxially expanding process in which a portion of a base pipe is expanded by use of an expander punch to form a processed pipe having a neck portion, of which the diameter is the same as that of the base pipe, a tapering portion, and an expanded portion, all of these portions being connected in coaxial relation to one another; and an eccentrically expanding process in which a central axis of the neck portion and a central axis of the expanded portion are decentered relative to each other, and the expanded portion of the processed pipe is further expanded by use of an expander punch having a diameter larger than that of the expander punch used in the coaxially expanding process, thereby forming an eccentrically expanded pipe. In this method, the coaxially expanding process is performed one time or a plurality of times, while the eccentrically expanding process is performed only one time.

In the coaxially expanding process according to the invention, the pipe is coaxially expanded by use of the expander punch, and decentering is not performed in this process. It is preferable to expand the portion of the base pipe in a plurality of stages by use of expander punches of various diameters, in other words, to perform this coaxially expanding process a plurality of times, depending on a desired expansion ratio. As an example, the pipe is preferably expanded at a low expansion ratio (for example, 30 to 55%; specifically, 35 to 50%) in a first coaxially expanding process, and then expanded at a high expansion ratio (for example, 65 to 85%; specifically, 70 to 80%) in a second coaxially expanding process. By expanding the pipe in stages in this manner, the pipe can be safely expanded without being cracked even in cases where the desired expansion ratio is high. According to the Japanese Industrial Standards (JIS), the expansion ratio is represented by the following formula; and in the invention, the expansion ratio is calculated using the diameter of the base pipe as "D" in the following formula.

$$\text{Expansion ratio} = \frac{D1 - D}{D} \times 100\% \qquad \text{[Formula1]}$$

D: Outside Diameter of Pipe Before Pipe Expansion

D1: Outside Diameter of Pipe After Pipe Expansion

It is preferable that, in the coaxially expanding process, 80% or more of pipe expansion is performed relative to a desired expansion ratio (that is, an expansion ratio of the expanded portion of the eccentrically expanded pipe). For example, if the desired expansion ratio is 90%, an expansion ratio of the expanded portion of the processed pipe is preferably 70% or more after the coaxially expanding process.

Now, in the eccentrically expanding process according to the invention, the central axis of the neck portion and that of the expanded portion are decentered relative to each other, and the expanded portion of the processed pipe after the coaxially expanding process is further expanded, thereby forming the eccentrically expanded pipe. This eccentrically expanding process is performed only one time, without being divided into a plurality of stages. As mentioned above, the coaxial expansion of the pipe can be achieved in one stage or in a plurality of stages with little possibility of formation of cracks or the like. On the other hand, if the eccentric expansion of the pipe is achieved in a plurality of stages, there is a possibility that cracks may be formed on the pipe since an expansion ratio of a portion of the pipe, which is highly expanded at the time of decentering, becomes substantially high. For this reason, the eccentrically expanding process is performed only one time.

As aforementioned, according to the invention, the multistage eccentric expansion of the pipe is never performed, and instead, the coaxial expansion of the pipe is performed in one stage or in a plurality of stages, and subsequently, the eccentric expansion is accomplished in one stage. As a result, the eccentrically expanded pipe can be formed without any cracks or the like formed thereon.

The method of the invention for forming an eccentrically expanded pipe is suitable, particularly, for making a pipe expanded at a high expansion ratio of 90% or more in its expanded portion. In this case, the pipe is expanded by a plurality of coaxially expanding operations such that the expansion ratio of the expanded portion of the processed pipe becomes 70 to 80% after the coaxially expanding process. And then, the pipe is further expanded such that the expansion ratio of the expanded portion of the eccentrically expanded pipe becomes 90% or more after the eccentrically expanding process. This is a preferable procedure to surely prevent the formation of cracks. In this manner, the present invention makes it possible to integrally form an eccentrically expanded pipe, without forming any cracks or the like thereon, even in cases where the expanded portion of the eccentrically expanded pipe is desired to be expanded at a high expansion ratio such as 90% or more.

The method of the invention for forming an eccentrically expanded pipe is suitable, particularly, for making a fuel inlet pipe. In recent years, a type of fuel inlet pipe called one-inch eccentrically expanded fuel inlet has been developed. The one-inch eccentrically expanded fuel inlet has an expansion ratio of over 90% in its large-diameter portion, and moreover, its small-diameter portion and large-diameter portion are in eccentric relation to each other (see FIG. 6). Therefore, it has been considered to be impossible to integrally form this type of fuel inlet pipe so far; however, it was made possible for the first time by use of the forming method of the invention.

In cases where the method of the invention for forming an eccentrically expanded pipe is applied to the making of the fuel inlet pipe, it is preferable, in the eccentrically expanding process, to dispose HAZ portions in the range of 45 to 135 degrees relative to a direction of eccentricity, seen in section of the pipe. A HAZ portion means a weld heat affected zone (referred to as a HAZ in general). More specifically, it is a portion formed on the periphery of weld metal when flux and part of base metal are fused by heat energy such as an arc.

Since the HAZ portions are different from the other portions in expanding properties, it is not preferable to dispose the HAZ portions in an area where the pipe is highly expanded at the time of decentering, that is, in an upper part of the fuel inlet pipe. This is because there is a possibility that the pipe might be cracked if the HAZ portions are disposed in such an area. On the contrary, it is preferable to dispose the HAZ portions in an area where the pipe is not so highly expanded at the time of decentering, that is, in a lower part of the fuel inlet pipe. However, the HAZ portions are easily cracked by a shock, such as an automobile collision, and therefore, if the HAZ portions are disposed in the lower part of the fuel inlet pipe, fuel leaks may be caused in the case of formation of cracks in the HAZ portions. Consequently, it is preferable to dispose the HAZ portions in the range of 45 to 136 degrees relative to the direction of eccentricity, seen in section of the pipe, such that the HAZ portions can be prevented from being cracked at the time of decentering, and such that even in the event that the HAZ portions are cracked by the automobile collision or the like, fuel leakage from the cracked portions can be prevented.

When the eccentrically expanding process according to the invention is implemented, the following device is preferably used. That is, an eccentrically pipe-expanding device comprising:

neck-portion holding means moveable in a predetermined radial direction while holding a periphery of the neck portion of the processed pipe;

neck-portion moving means for moving the neck-portion holding means in the predetermined radial direction, thereby placing the neck portion and the expanded portion in eccentric relation to each other; and an expander punch for being pressed, from the expanded portion of the processed pipe held by the neck-portion holding means, into the expanded portion in an axial direction thereof. Use of the eccentrically pipe-expanding device facilitates the eccentrically expanding process of the invention.

BRIEF DESCRIPTION OF THE DRAWINGS

The invention will now be described, by way of example, with reference to the accompanying drawings, in which.

DESCRIPTION OF THE PREFERRED EMBODIMENTS

In this embodiment, the making of a fuel inlet pipe FP (see FIG. 6) as an eccentrically expanded pipe is taken as an example. The fabrication procedure is divided into three processes, i.e., a first process (a first coaxially expanding process), a second process (a second coaxially expanding process), and a third process (an eccentrically expanding process), each of which is described below.

(1) First Process (First Coaxially Expanding Process)

Figure 1A:
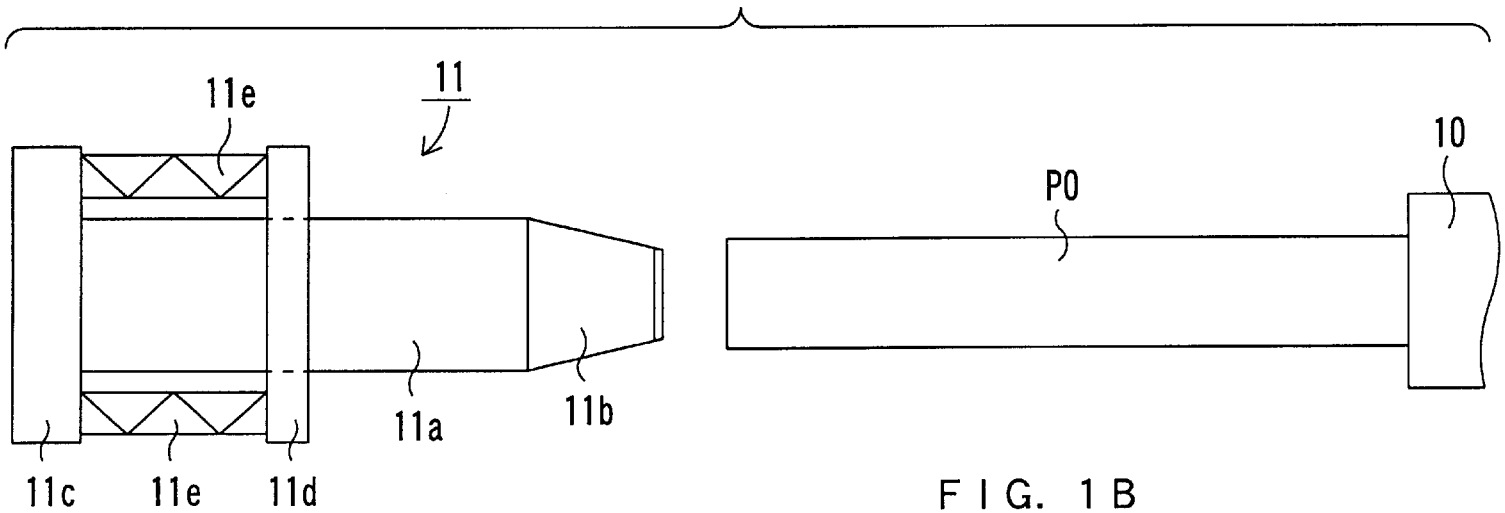
FIGS. 1A and 1B are explanatory views showing a first process according to an embodiment of the invention.
Figure 1B:
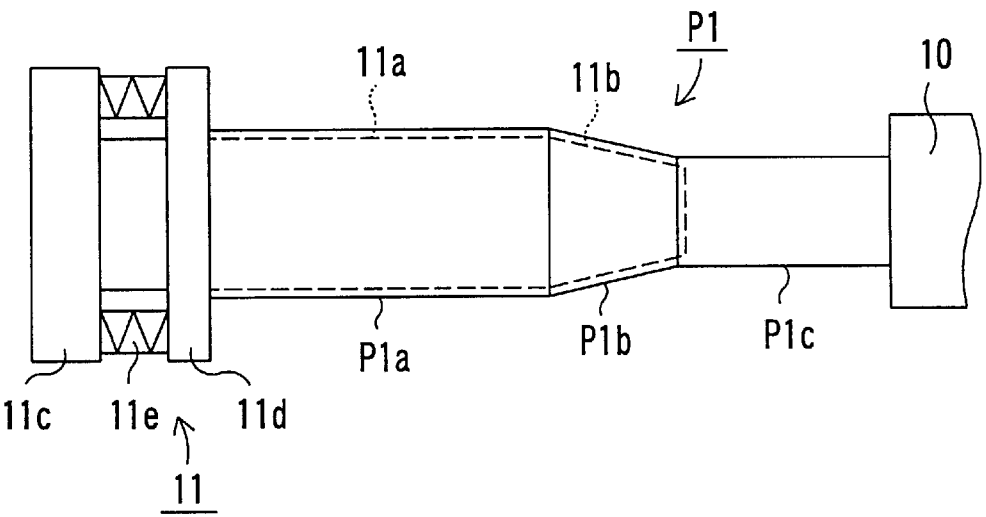

FIG. 1A is an explanatory view showing a state prior to the first process, and FIG. 1B is an explanatory view showing a state during the first process.

First of all, a one-inch straight pipe (of which the outside diameter is 25.4 mm) is prepared as a base pipe P0, and a first expander punch 11 is pressed into the base pipe P0, with one end of the base pipe P0 thrust against a stopper 10, from an opening at the other end of the base pipe P0. The first expander punch 11 comprises a first punch body 11*a* of cylindrical shape, a first conical top 11*b* formed at an end of the first punch body 11*a* in coaxial relation thereto, and a first pedestal 11*c* attached to a base end of the first punch body 11*a*. The outside diameter of a tip of the first conical top 11*b* is approximately equal to the inside diameter of the base pipe P0. Also, the first punch body 11*a* is inserted in a first ring 11*d*, which is coupled, via first springs 11*e*, to the first pedestal 11*c*.

The first expander punch 11 is shifted in an axial direction of the base pipe P0 such that the tip of the first conical top 11*b* is pressed into the base pipe P0 from the opening at the other end thereof. Then, the base pipe P0 is expanded to conform to the shape of the first expander punch 11 as the first expander punch 11 is pressed thereinto, since the base pipe P0 is thrust, at its one end, against the stopper 10.

Even after the first ring 11*d* externally attached to the first punch body 11*a* comes into contact with the other end of the base pipe P0, the first expander punch 11 is further pressed into the base pipe P0 against the urging force of the first springs 11*e*. Once the first expander punch 11 is pressed in up to a place where it can no longer proceed in a pressing direction, the first expander punch 11 is then shifted in the reverse direction, that is, in a drawing direction.

As a result, the base pipe P0 is formed into a first processed pipe P1 by plasticity. The first processed pipe P1 comprises a first expanded portion P1*a* expanded by the first punch body 11*a* of the first expander punch 11, a first tapering portion P1*b* shaped in conformity with the shape of the first conical top 11*b* of the first expander punch 11, and a first neck portion P1*c*, having the original diameter of the base pipe P0, into which the first expander punch 11 was not inserted. These portions P1*a* to P1*c* are formed in coaxial relation to one another. In this example, the outside diameter of the first expanded portion P1*a* is 36.2 mm, and the expansion ratio thereof is 42.5% relative to the base pipe P0.

(2) Second Process (Second Coaxially Expanding Process)

Figure 2A:
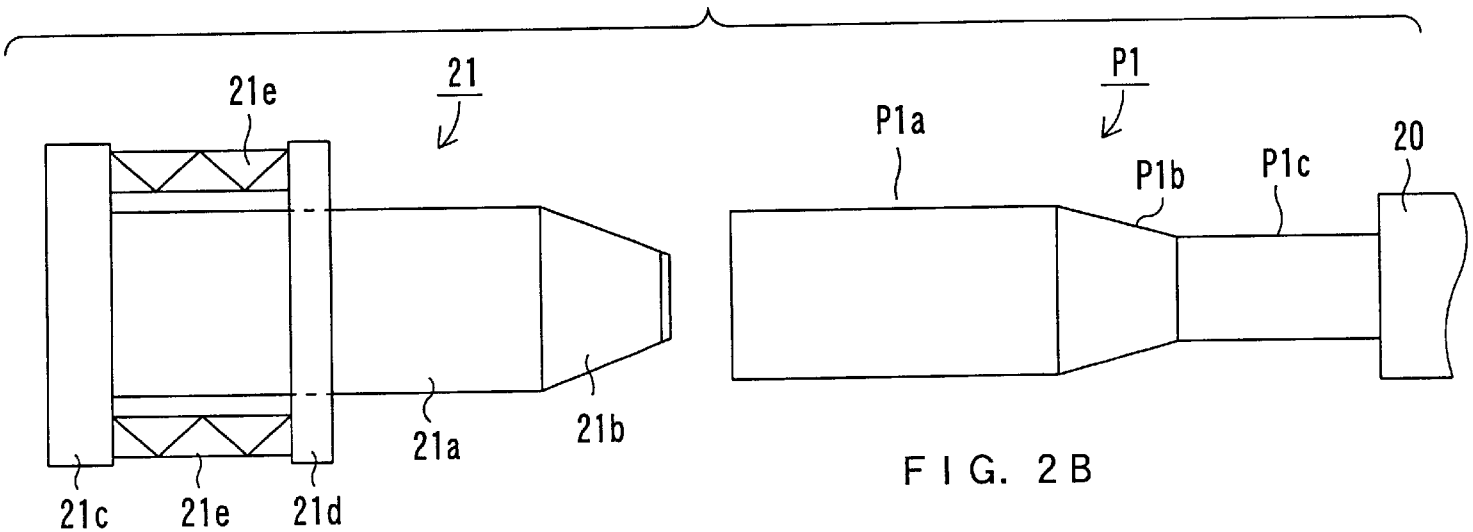
FIGS. 2A and 2B are explanatory views showing a second process according to the embodiment.
Figure 2B:
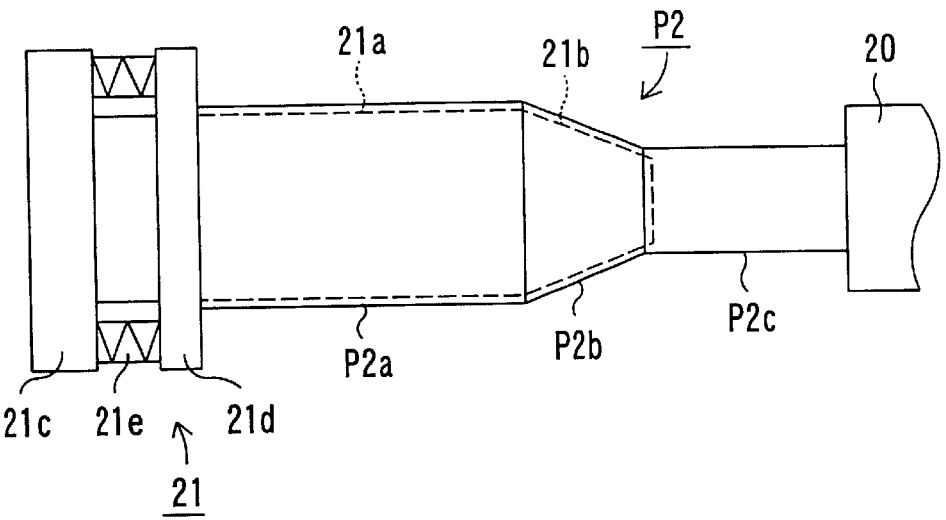

FIG. 2A is an explanatory view showing a state prior to the second process, and FIG. 2B is an explanatory view showing a state during the second process.

First of all, a second expander punch 21 is pressed into the first processed pipe P1 resulting from the first process, with one end of the first processed pipe P1 thrust against a stopper 20, from an opening at the other end of the first processed pipe P1.

The second expander punch 21 comprises a second punch body 21*a* of cylindrical shape, a second conical top 21*b* formed at an end of the second punch body 21*a* in coaxial relation thereto, and a second pedestal 21*c* attached to a base end of the second punch body 21*a*. The outside diameter of a tip of the second conical top 21*b* is approximately equal to the inside diameter of the first neck portion P1*c* of the first processed pipe P1. Also, the second punch body 21*a* is inserted in a second ring 21*d*, which is coupled, via second springs 21*e*, to the second pedestal 21*c*. The diameter of the second punch body 21*a* is larger than that of the first punch body 11*a*.

The second expander punch 21 is shifted in an axial direction of the first processed pipe P1 such that the tip of the second conical top 21*b* is pressed into the first processed pipe P1 from the opening at the other end thereof (i.e., at an end of the first expanded portion P1*a*). Then, the first processed pipe P1 is expanded to conform to the shape of the second expander punch 21 as the second expander punch 21 is pressed thereinto, since the first processed pipe P1 is thrust, at its one end (i.e., at an end of the first neck portion P1*c*), against the stopper 20.

Even after the second ring 21*d* externally attached to the second punch body 21*a* comes into contact with the other end of the first processed pipe P1, the second expander punch 21 is further pressed into the first processed pipe P1 against the urging force of the second springs 21*e*. Once the second expander punch 21 is pressed in up to a place where it can no longer proceed in a pressing direction, the second expander punch 21 is then shifted in the reversed direction, that is, in a drawing direction.

As a result, the first processed pipe P1 is formed into a second processed pipe P2 by plasticity. The second processed pipe P2 comprises a second expanded portion P2*a* expanded by the second punch body 21*a* of the second expander punch 21, a second tapering portion P2*b* shaped in conformity with the shape of the second conical top 21*b* of the second expander punch 21, and a second neck portion P2*c*, having the original diameter of the base pipe P0, into which the second expander punch 21 was not inserted. These portions P2*a* to P2*c* are formed in coaxial relation to one another. In this example, the outside diameter of the second expanded portion P2*a* is 45.0 mm, and the expansion ratio thereof is 77.2% relative to the base pipe P0.

(3) Third Process (Eccentrically Expanding Process)

Figure 3A:
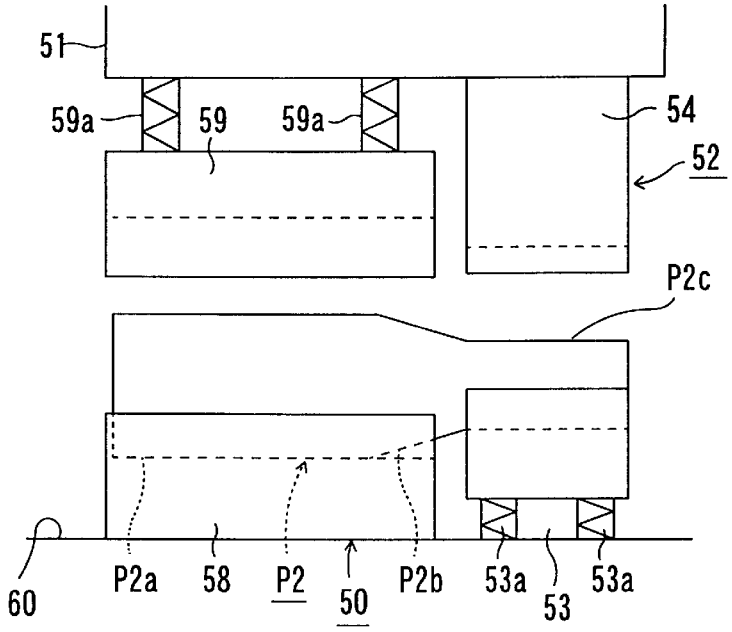
FIGS. 3A, 3B and 3C are explanatory views showing a third process according to the embodiment as well as schematic diagrams showing an eccentrically pipe-expanding device to be used therein.
Figure 3B:
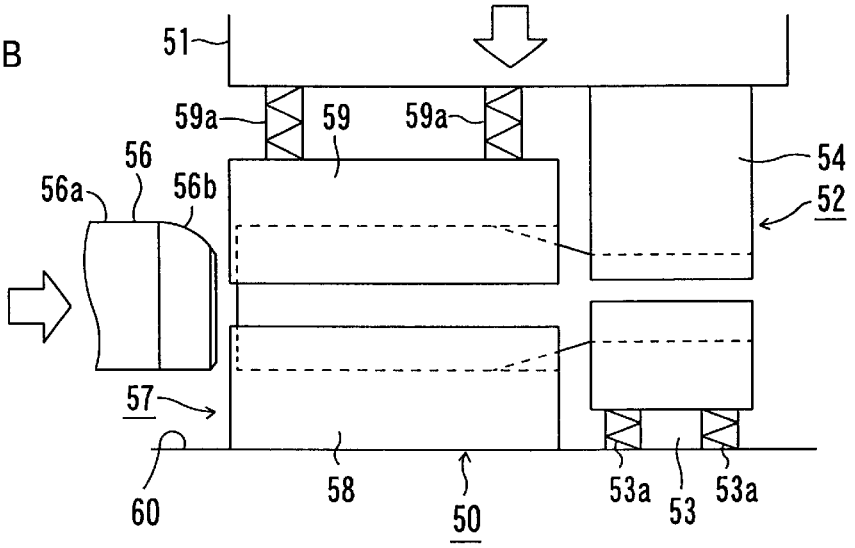
Figure 3C:
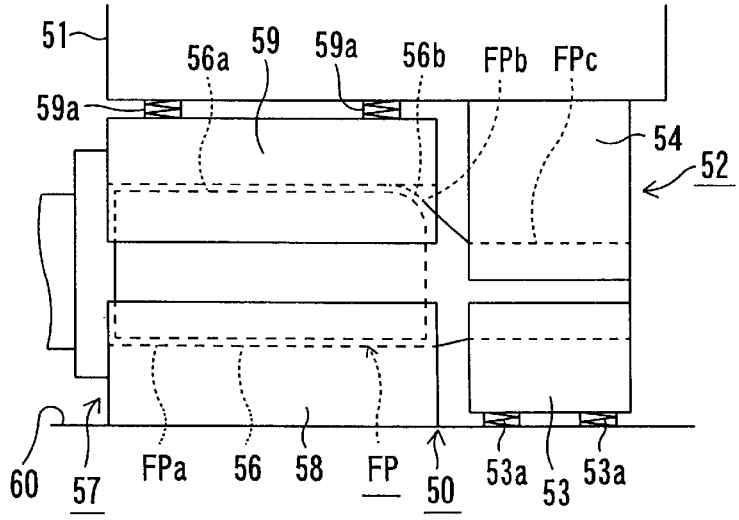

FIG. 3A is an explanatory view showing a state prior to the third process, and FIGS. 3B and 3C are explanatory views each showing a state during the third process.

Prior to the description of the third process, composition of an eccentrically pipe-expanding device 50 is first described. The eccentrically pipe-expanding device 50 comprises a movable body 51, a neck-portion holder 52, a third expander punch 56, and an expanded-portion holder 57, and it is set up on a working bench 60.

The movable body 51 can be moved, by an actuator (not shown) such as a hydraulic cylinder or the like, in a vertical direction relative to the working bench 60.

The neck-portion holder 52 is composed of a lower neck-portion holding member 53 being capable of moving up and down via a plurality of springs 53*a* provided on the working bench 60, and an upper neck-portion holding member 54 fixed on a bottom face of the movable body 51. Both the members 53 and 54 pinch and hold the second neck portion P2*c* of the second processed pipe P2 from its upper and lower sides to prevent the second processed pipe P2 from moving in its axial direction (specifically, in a direction in which the third expander punch 56 is inserted, or in the right direction in FIGS. 3A to 3C).

Figure 6:
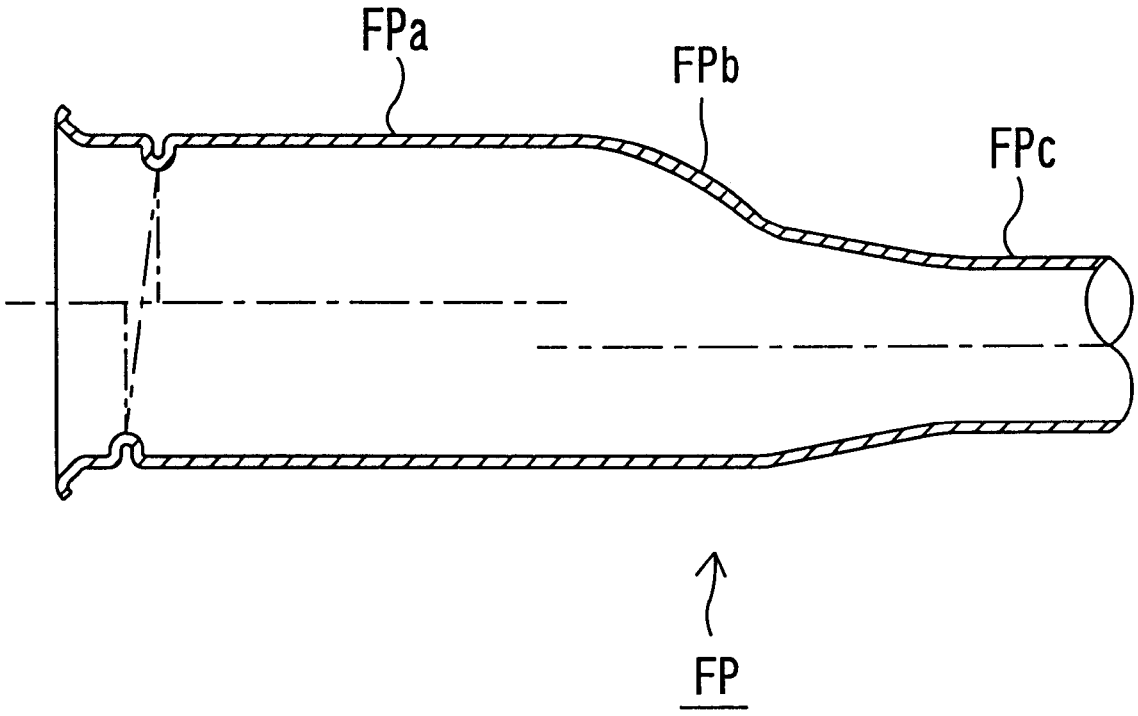
FIG. 6 is a sectional view of a fuel inlet pipe.

The third expander punch 56 comprises a cylindrically-shaped third punch body 56*a* and a tip 56*b*. The third, punch body 56*a* and the tip 56*b* correspond to the large-diameter portion FPa and the gradually changing portion FPb, respectively, of the fuel inlet pipe FP as shown in FIG. 6. The diameter of the third punch body 56*a* is larger than that of the second punch body 21*a*. The tip 56*b* of the third expander punch 56 is formed in such a manner that an upper portion thereof slopes downward, forming a curve toward an end of the tip 56*b*.

The expanded-portion holder 57 is composed of a lower expanded-portion holding member 58 fixed on the working bench 60, and an upper expanded-portion holding member 59 being capable of moving up and down via a plurality of springs 59*a* provided on the bottom face of the movable body 51. Both the members 58 and 59 pinch and hold the second expanded portion P2*a* of the second processed pipe P2 from its upper and lower sides.

Now, the procedure of eccentrically expanding the second processed pipe P2 by use of the eccentrically pipe-expanding device 50 is described. First of all, as shown in FIG. 3A, the movable body 51 is set above the working bench 60, being greatly apart therefrom. In this state, the second neck portion P2*c* and the second expanded portion P2*a* of the second processed pipe P2 are placed, respectively, on the lower neck-portion holding member 53 and the lower expanded-portion holding member 58.

Figure 4:
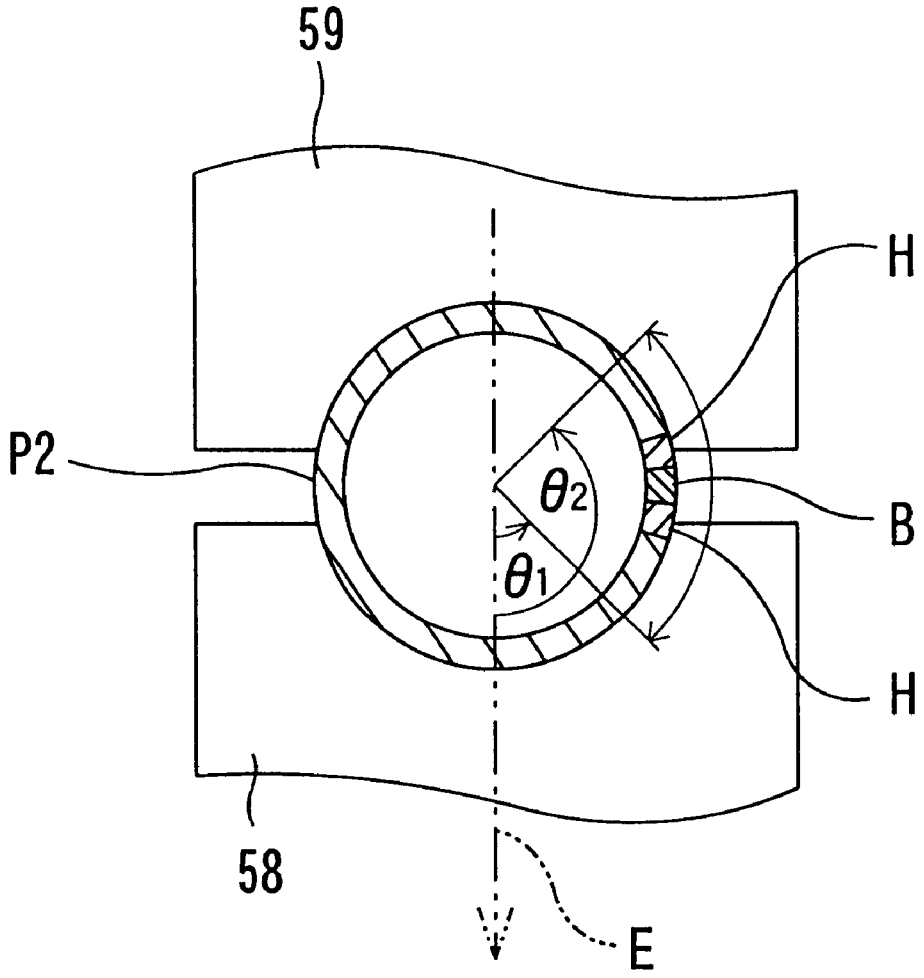
FIG. 4 is an explanatory view showing arrangement of HAZ portions according to the embodiment.

If the second processed pipe P2 has a beaded portion (weld metal portion) B and HAZ (heat affected zone) portions H as shown in FIG. 4, the second processed pipe P2 is disposed in such a manner that the beaded portion B as well as the HAZ portions H are located in the range of 45 (θ1) to 135 (θ2) degrees (preferably, at an angle of approximately 90 degrees) relative to a direction of eccentricity (E), i.e., the vertical direction.

Subsequently, as shown in FIG. 3B, the movable body 51 is moved toward the working bench 60. Then, the second neck portion P2*c* and the second expanded portion P2*a* of the second processed pipe P2 are pinched and held, respectively, between the upper and lower neck-portion holding members 54, 53 and between the upper and lower expanded-portion holding members 59, 58. In this state, the second neck portion P2*c* is decentered relative to the second expanded portion P2*a*.

More specifically, with a downward movement of the movable body 51, the second neck portion P2*c* of the second processed pipe P2 is also moved downward by the upper neck-portion holding member 54, while the springs 53*a* provided between the lower neck-portion holding member 53 and the working bench 60 are compressed. Accordingly, a central axis of the second neck portion P2*c* is lowered after the movable body 51 is moved downward. On the other hand, even after the movable body 51 is moved downward, a central axis of the second expanded portion P2*a* is maintained at the same height as before the movable body 51 is moved downward, since the springs 59*a* provided between the movable body 51 and the upper expanded-portion holding member 59 are compressed. The amount of the downward movement of the movable body 51 is determined depending on a desired slippage between the central axis of the small-diameter portion FPc of the fuel inlet pipe FP and that of the large-diameter portion FPa thereof.

Further subsequently, as shown in FIG. 3C, the third expander punch 56 is moved in an axial direction of the second processed pipe P2 to be pressed into the second processed pipe P2 from an opening at the other end thereof (i.e., at an end of the second expanded portion P2*a*). Because the second processed pipe P2 is prevented, by the neck-portion holder 52, from moving in the axial direction, it is expanded in conformity with the shape of the third expander punch 56 as the third expander punch 56 is pressed into the second processed pipe P2.

At the same time, since the upper expanded-portion holding member 59 is provided on the bottom face of the movable body 51 via the springs 59*a*, if the third expander punch 56 is pressed into the second processed pipe P2, the third punch body 56*a* further expands the second expanded portion P2*a*, thereby compressing the springs 59*a* and raising the upper expanded-portion holding member 59.

As mentioned above, the movable body 51 is moved downward, and the neck-portion holder 52 gets out of alignment relative to the expanded-portion holder 57. As a result, the second neck portion P2*c* is decentered relative to the second expanded portion P2*a*, while the second expanded portion P2*a* is expanded by the third expander punch 56 in conformity with the shape thereof.

Consequently, the second processed pipe P2 is formed into the fuel inlet pipe FP by plasticity. The fuel inlet pipe FP is, as shown in FIG. 6, comprised of the large-diameter portion FPa expanded by the third punch body 56*a* of the third expander punch 56, the gradually changing portion FPb formed in conformity with the shape of the tip 56*b* of the third expander punch 56, and the small-diameter portion FPc, having the original diameter of the base pipe P0, into which the third expander punch 56 was not inserted. The large-diameter portion FPa and the small-diameter portion FPc are formed in eccentric relation to each other. There are, of course, no cracks formed on the large-diameter portion FPa nor on the gradually changing portion FPb, and no buckling caused to the small-diameter portion FPc. In this example, the outside diameter of the large-diameter portion FPa is 48.7 to 49.1 mm, and the expansion ratio thereof is 91.7 to 93.3% relative to the base pipe P0.

In these manners, by way of the first through third processes, the fuel inlet pipe FP can be produced as an eccentrically expanded pipe without formation of cracks or the like thereon, even in cases where a desired expansion ratio of the large-diameter portion FPa is high relative to the base pipe P0.

Also, the beaded portion B and the HAZ portions H are different from the other portions in expanding properties, and it is, therefore, preferable to dispose these portions to the bottom of the fuel inlet pipe FP, which is a region where the pipe is not highly expanded at the time of decentering. However, the beaded portion B and the HAZ portions H are easily cracked in the event that any shock is caused to the pipe, for example, in case of automobile collision, and, therefore, if these portions are disposed to the bottom of the fuel inlet pipe FP, fuel leaks might be caused in such an event. For this reason, in the embodiment, these portions are disposed in the range of 45 to 135 degrees relative to the direction of eccentricity, as shown in FIG. 4, seen in section of the pipe, thereby preventing formation of cracks at the time of decentering as well as preventing fuel from leaking out even in the event that these portions are cracked by the automobile collision or the like.

The present invention is, of course, not restricted to the above described embodiment, and may be practiced or embodied in still other ways without departing from the subject matter thereof.

For example, in the above embodiment, the coaxially expanding process is performed twice, but the coaxial expansion of the pipe may be accomplished in three or more processes. Otherwise, it may be accomplished in only one process depending on the expansion ratio desired.

Also, the eccentrically expanded pipe is not restricted to the fuel inlet pipe, and other types of pipes of any application can be produced as well according to the manufacturing method of the invention.

Figure 5:
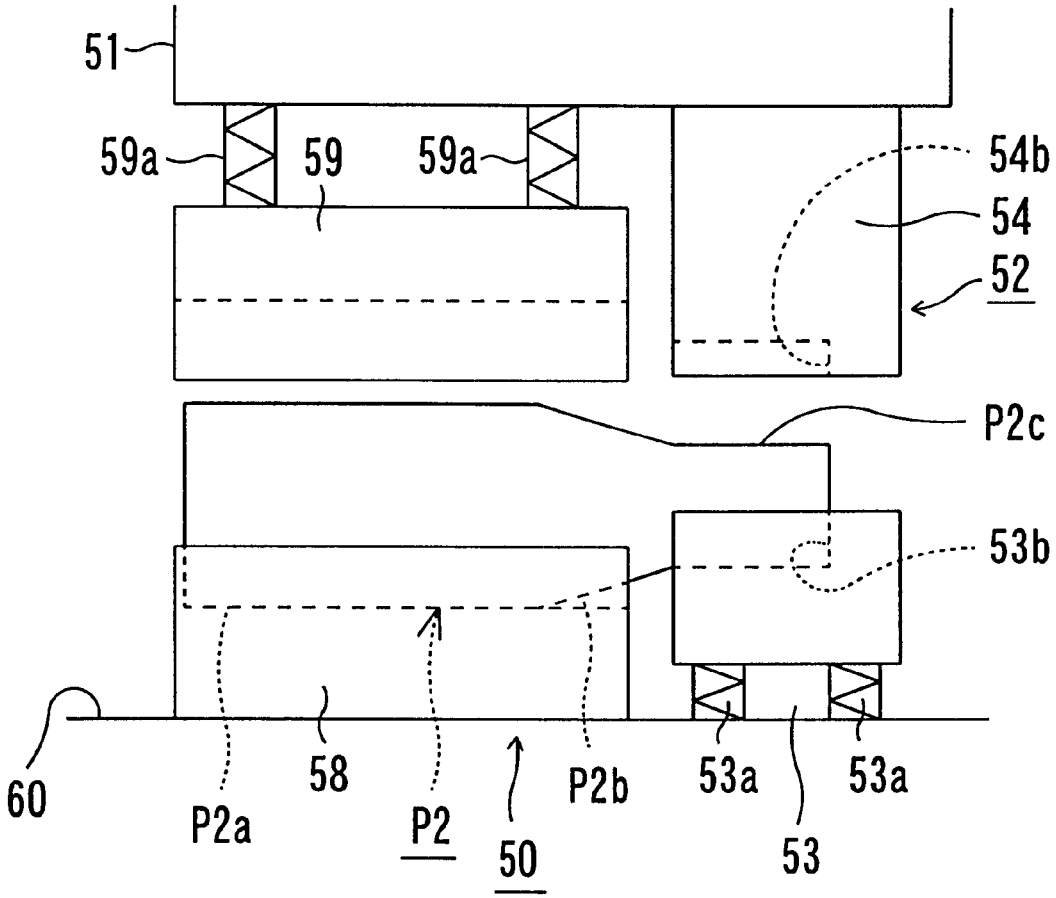
FIG. 5 is a schematic diagram showing an eccentrically pipe-expanding device according to another embodiment of the invention.

Furthermore, in the third process, stoppers for preventing movement in the axial direction of the second processed pipe P2 may be incorporated into the neck-portion holder 52. For example, as shown in FIG. 5, a wall 54*b* for abutting on the end face of the second neck portion P2*c* may be provided on a surface, on which the second neck portion P2*c* is placed, of the upper neck-portion holding member 54, and a wall 53*b* for abutting on the end face of the second neck portion P2*c* may be provided on a surface, on which the second neck portion P2*c* is placed, of the lower neck-portion holding member 53. In this case, the walls 53*b* and 54*b* function as the stoppers.

Wherefore, we claim:

1. A method of forming an eccentrically expanded pipe, the method comprising the steps of:

coaxially expanding a portion of a base pipe by use of a first expander punch to form an expanded portion, an intermediate tapering portion and a neck portion having a diameter the same as that of the base pipe, all of said portions being contiguously coaxially connected about a central axis;

decentering the expanded portion and the neck portion relative to one another to form a secondary axis spaced from the central axis by use of a second expander punch having a diameter larger than that of the first expander punch, thereby forming an eccentrically expanded pipe, and coaxially expanding the base pipe at least one time, while the decentering step is performed only one time.

2. The method of forming an eccentrically expanded pipe according to claim 1, wherein the method further comprises a step of coaxially expanding the portion of the base pipe a plurality of times using expander punches of various diameters.

3. The method of forming an eccentrically expanded pipe according to claim 1, wherein the method further comprises a step of coaxially expanding the portion of the base pipe a plurality of times using expander punches of increasing diameter.

4. The method of forming an eccentrically expanded pipe according to claim 1, wherein the method further comprises the steps of coaxially expanding the expanded portion of the processed pipe at a ratio of between about 70 to 80% relative to the base pipe, and further expanding the expanded portion during decentering at a ratio of at least 90% relative to the base pipe.

5. The method of forming an eccentrically expanded pipe according to claim 1, wherein the eccentrically expanded pipe formed by the method is a fuel inlet pipe.

6. The method of forming an eccentrically expanded pipe according to claim 5, wherein the base pipe is initially formed having HAZ portions, and during decentering the HAZ portions are disposed between a range of about 45 to 135 degrees relative to a direction of eccentricity defined by the central and secondary axis.

7. A pipe-expanding device for eccentrically expanding a processed pipe having an expanded portion, an intermediate tapering portion, and a neck portion, all of said portions being contiguously coaxially connected about a central axis, the pipe-expanding device comprising:

neck-portion holding means moveable in a predetermined radial direction for holding a periphery of the neck portion of the processed pipe;

neck-portion moving means for moving the neck-portion holding means in the predetermined radial direction to facilitate displacement of the neck portion and the expanded portion in eccentric relation to each other; and an axially moveable expander punch for axial insertion into an opening end of the expanded portion of the processed pipe held by the neck-portion holding means to facilitate further expansion of the expanded portion.

8. The pipe-expanding device for eccentrically expanding a processed pipe as set forth in claim 7, wherein the axially moveable expander punch further comprises a cylindraceous body having an insertion tip, the body defining a substantially constant diameter about the central axis and wherein the insertion tip has an upper portion having a slope defined by a radially decreasing diameter from the constant diameter towards an end of the tip.

9. The pipe-expanding device for eccentrically expanding a processed pipe as set forth in claim 8, further comprising an expanded portion holding means having a displaceable pipe holding means for accommodating the further expansion of the expanded portion of the pipe.

10. The pipe-expanding device for eccentrically expanding a processed pipe as set forth in claim 9, wherein the neck portion holding means has a displaceable neck portion holding means for accommodating the eccentric displacement of the neck portion relative to the central axis caused by the neck portion moving means.

11. The pipe-expanding device for eccentrically expanding a processed pipe as set forth in claim 10, wherein the eccentric displacement of the neck portion relative to the central axis creates the secondary axis about which the neck portion is substantially defined.

* * * * *